United States Patent [19]

Soga

[11] Patent Number: 4,813,868

[45] Date of Patent: Mar. 21, 1989

[54] IMAGE FIXING METHOD

[75] Inventor: Setsuo Soga, Tokyo, Japan

[73] Assignee: Ricoh Company, Ltd., Tokyo, Japan

[21] Appl. No.: 112,089

[22] Filed: Oct. 26, 1987

[30] Foreign Application Priority Data

Oct. 24, 1986 [JP] Japan ..... 61-253343

[51] Int. Cl.[4] ..... H05B 3/10; F27B 9/28

[52] U.S. Cl. ..... 432/8; 432/60; 219/216; 355/3 FU

[58] Field of Search ..... 432/60, 8, 228; 219/469; 355/3 FU

[56] References Cited

U.S. PATENT DOCUMENTS

| | | | |
|---|---|---|---|
| 4,038,026 | 7/1977 | Wada et al. | 432/60 |
| 4,101,267 | 7/1978 | Mueller | 432/60 |
| 4,119,831 | 10/1978 | Sato | 219/216 |
| 4,487,158 | 12/1984 | Kayson | 432/60 |
| 4,639,405 | 1/1987 | Franke | 219/216 |
| 4,653,897 | 3/1987 | Fromam | 432/60 |
| 4,727,394 | 2/1988 | Bov, Jr. et al. | 432/60 |
| 4,745,431 | 5/1988 | Kogure et al. | 355/3 FU |

*Primary Examiner*—Henry C. Yuen

*Attorney, Agent, or Firm*—Oblon, Fisher, Spivak, McClelland & Maier

[57] ABSTRACT

A heating roller having a surface layer of Teflon and a pressing roller having a surface layer of an elastomeric material are held rotatably against each other for fixing a full-color toner image to a toner carrier therebetween. The ratio (1/V) between the nip width 1 of the heating and pressing rollers and the peripheral speed V of the rollers is selected to be at least 0.06, and the pressure of contact per unit area between the heating and pressing rollers at their nip region is selected to be at least 7 kg/cm$^2$, for increasing a temperature range corresponding to the rubber range of toners used. The toners which have a small molecular weight and a small molecular weight distribution are prevented from being offset before the toners are fixed. Teflon with desirable features can therefore be used as the surface layer of the heating roller.

6 Claims, 2 Drawing Sheets

IMAGE FIXING METHOD

BACKGROUND OF THE INVENTION

The present invention relates to an image fixing method, and more particularly to an image fixing method for a full-color electrophotographic copying machine including a heating roller.

One known image fixing method in a full-color copying machine employs a heating roller and a pressing roller which are held in pressed contact with each other. According to this know image fixing method, a toner carrier (hereinafter referred to as a "copy sheet") bearing a toner image formed by superposing three or four colored toner images is heated and pressed by the nip region of the heating and pressing rollers.

An image reproduced by a full-color copying process is preferably required to have more gloss than a monochromatic image and also to have light transmission capability (color reproduciability) so that the image can be used in an overhead projector.

For the above reasons, the toners employed in the full-color copying process have small molecular weights and small molecular weight distributions, with the result that the toner cohesion will be small.

Fixing of toner to a toner sheet is regarded as adhesion of the toner to the toner sheet (see, for example, a paper entitled "Fixing ability of electrophotographic toner" at the 51st research meeting of the Electrophotographic Society.

The paper referred to above indicates that adhesion includes the elemental processes of liquefaction, flowing, wetting, and solidification, and that in order to fix toner, the viscoelasticity of toner is required to be within a certain range due to heat fusion.

In addition, the hot offset of toner (which means toner transfer when the toner is heated) is generated by cohesion destruction which occurs when the adhesive force between the toner and the heating roller is stronger than the cohesive force of the toner.

Therefore, the toner viscoelasticity and adhesion are important parameters for fixing toner.

The toner viscoelasticity is affected by the molecular weight and molecular weight distribution of toner.

FIG. 3 of the accompanying drawings shows the relationship between the molecular weight of toner and a temperature range in which the toner is fixable, the temperature range being a factor in toner fixing characteristics.

The hatched range shown in FIG. 3 which is surrounded by fixing starting temperatures and offset starting temperatures indicates a good toner fixing range.

The good toner fixing range is a stage prior to a flowing range in which the toner cohesion is destroyed, and is generally referred to as a rubber range. As is apparent from FIG. 3, if the width (temperature width) of the rubber range is narrow, the toner cohesive force tends to be small as is the case with a small toner molecular weight. If the width of the rubber range is narrow, therefore, the offset is liable to happen and a fixture failure is apt to occur.

It is known that the heating roller is made of Teflon which meets desired heat resistance and durability against a plurality of colored toners used in full-color copying.

However, even if Teflon is used, the offset is likely to take place when toner is fixed in a narrow rubber range, and hence the desired features of Teflon cannot be utilized in such a narrow rubber range.

In order to avoid the above problem, a heating roller in a fixing device in a full-color copying machine is made of silicone rubber. Silicone rubber is believed to be better in toner peelability than Teflon.

However, a toner fixing method using a heating roller of silicone rubber has the following disadvantages:

(1) Since silicone rubber is less durable against solvents and chemicals than Teflon, a fixing roller is contaminated by a pigment or dye of colored toner. As a result, the fixing roller has poor toner peelability and becomes short in service life. This phenomenon does not happen when only black toner is used.

(2) Because silicone rubber is lower in mechanical strength than Teflon, the types of copy sheets that can be used are much more limited than would be available in a monochromatic copying process, and hence a range of usable copy sheets is limited.

(3) An adhesive layer between the core of the heating roller and a silicone rubber layer around the core is susceptible to high temperatures, temperature control must be effected to give a desired level of peeling resistance to the adhesive layer on its surface held against the core. The roller surface cannot easly reach the temperature at which toner can be fixed because of the difference between heat transfer characteristics of the core and the silicone rubber layer. To solve this problem, it is proposed to position another heating roller held against the surface of the existing heating roller for keeping the surface of the silicone rubber roller at the toner fixing temperature. With this proposed arrangement, however, since the area where the heating rollers contact each other is small, heat transfer cannot well be effected therebetween, and as a consequence high-speed toner fixing cannot be performed.

(4) A greater amount of toner coheres in a full-color copying process than a monochromatic copying process. Therefore, since the thickness of the toner layer is large, surface irregularties are developed on the copy sheet even if it is heated and pressed.

SUMMARY OF THE INVENTION

Accordingly, it is an object of the present invention to provide an image fixing method which uses a heating roller for heating a fixing roller, the heating roller having a layer of Teflon that has heretofore been used heretofore.

Another object of the present invention is to provide an image fixing method which can meet requirements of a full-color copying process with a simple arrangement.

To achieve the above objects, according to the present invention, a heating roller and a pressing roller are held in pressed contact with each other, the ratio (1/V) between the nip width 1 of the heating and pressing rollers and the peripheral speed V of the rollers is selected to be at least 0.06, and the pressure of contact per unit area between the heating and pressing rollers at their nip region is selected to be at least 7 kg/cm$^2$, for fixing a multicolor toner image to a toner carrier.

With the present invention, toners on the toner carrier are given a good toner fixing range which does not exceed 40° C. from a toner fixing starting temperature for the toners.

Moreover, since a wide good toner fixing range is available, full-color copying toners having small molecular weights, molecular weight distributions, and relatively small toner cohesive forces are prevented from adhering to Teflon, and hence a heating roller can have a Teflon layer.

Furthermore, an image produced by the full-color copying process is glossy and light-transmissive.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
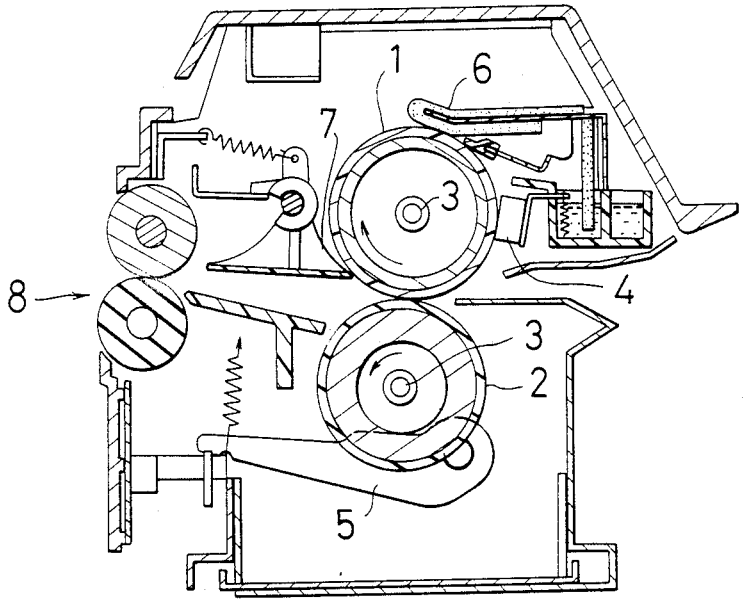
FIG. 1 is a cross-sectional view of an image fixing device used for carrying out an image fixing method of the present invention.
Figure 2:
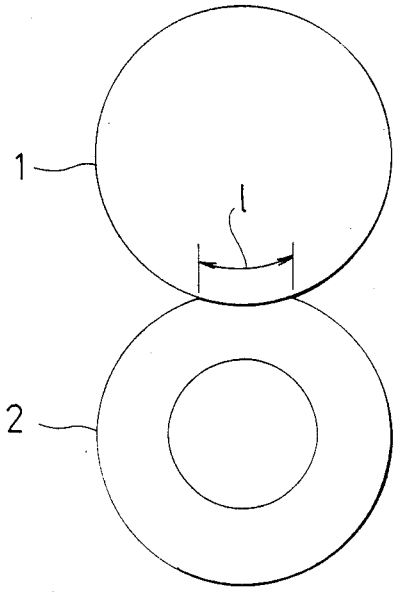
FIG. 2 is a schematic view explaining the nip region of rollers in the image fixing device.

An image fixing method according to the present invention can be effected, for example, by an image fixing device as shown in FIG. 1.

The image fixing device includes a heating roller 1 having a surface layer of Teflon and a pressing roller 2 having a surface layer of an elastomeric material such as silicone rubber.

Each of the heating and pressing rollers 1, 2 has a heater 3 housed therein. However, the pressing roller 2 may not have its own heater (as described later on). A temperature sensor 4 such as thermistor is held against the surface of the heating roller 1 for detecting the surface temperature thereof.

A detected signal from the thermistor 4 of applied to a fixing temperature control unit (not shown), which is responsive to the signal from the thermistor 4 for controlling the heaters 3 so that the surface temperature of the heating roller 1 will not exceed an offset starting temperature above a fixing starting temperature for toner to be fixed.

Figure 3:
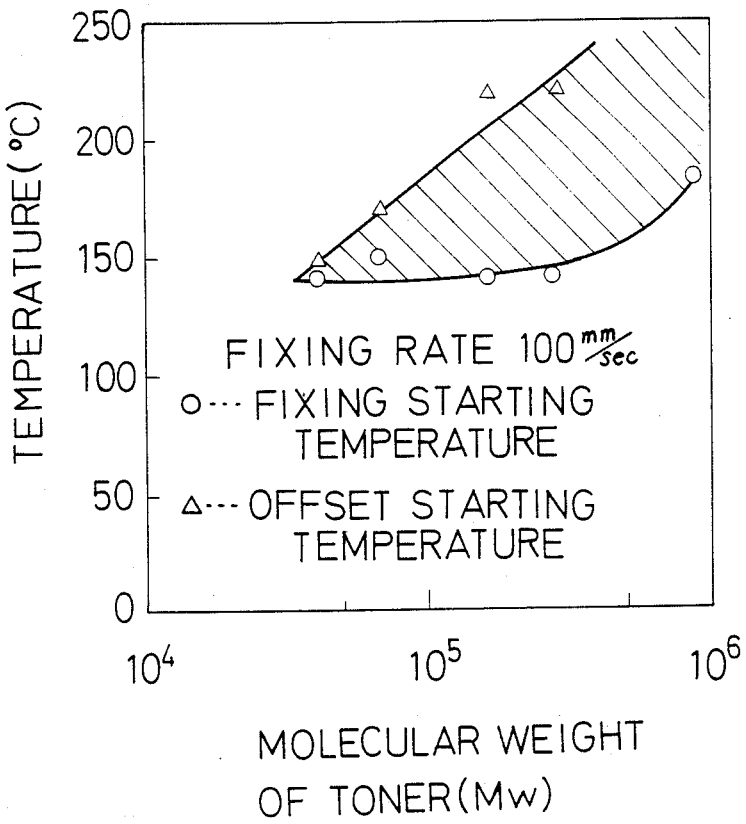
FIG. 3 is a graph showing the relationship between temperature at which toner can be fixed and toner molecular weights.

The surface temperature of the heating roller 1 controlled by the thermistor 4 is determined to be in a temperature range corresponding to the rubber range of toner. More specifically, the surface temperature of the heating roller 1 is not in excess of 40° C. above the toner fixing starting temperature shown in FIG. 3.

The heating roller 1 and the pressing roller 2 are pressed against each other by means of a pressing cam 5, and are driven to rotate in their respective directions of the arrows by a driving means (not shown). The pressing cam 5 presses the heating roller 1 and the pressing roller 2 against each other so that the pressure of contact C per nip area will be 7 kg/cm$^2$ or higher.

The contact pressure C is expressed by:

$$C = P/al \text{ (kg/cm}^2\text{)} \quad (1)$$

where l is the nip width (cm) of the rollers 1, 2, a is the axial length (cm) of the contacting area between the rollers 1, 2, and P is the total pressure (kg) applied to the rollers 1, 2.

The driving means drives the rollers 1, 2, to rotate about their own axes such that the rate (1/V) between the width l (cm) of the rollers 1, 2 and the peripheral speed V (cm/sec.) of the rollers 1, 2 will meet:

$$1/V \geqq 0.06 \text{ (sec.)} \quad (2)$$

The image fixing device also has an oil applicator 6 for applying silicone oil to the circumferential surface of the heating roller 1, a peeling member 7 for peeling a copy sheet (not shown) to which an image has been fixed from the heating roller 1, and sheet discharge rollers 8 for discharging a fixed copy sheet from the image fixing device.

The following experiment was conducted using the image fixing device as constructed above.

The experiment was effected in order to known how the image fixing device of the invention is better than a conventional image fixing device as to the toner fixing temperature width or range (°C.), the glossiness (%) of a copied image, and the availability of transfer paper (which means the number of available types of transfer paper that can be used as a copy sheet; the greater the number of available types of transfer paper, the greater the availability of transfer paper).

The glossiness (%) was measured at an illumination angle of 60° according to JIS Z8741, using a glossmeter manufactured by Japan Denshoku Kogyo K.K.

The following sheets of Transfer paper (copy sheets) were used:

(a) Type 6000 manufactured by K. K. Ricoh;
(b) OHP film manufactured by K. K. Ricoh;
(c) 50 g/cm$^2$–90 g/cm$^2$ paper manufactured by NBS Co.; and
(d) Groundwood paper.

Toners used were toners (molecular weight: $6\times10^4$) for use with a color copying machine "Ricoh Color 5000" manufactured by K. K. Ricoh. The toners had a softening temperature of 70° C. and a flow starting temperature (liquefaction temperature) of 88° C. as measured by a flow tester manufactured by Shimazu Seisakusho. The temperature range between the toner softening temperature and the flow starting temperature is generally known as the rubber range. The smaller the rubber range, the smaller the toner cohesive force. It has been believed that those toners which have a small rubber range and a small molecular weight cannot be fixed by a roller having a Teflon surface layer (see FIG. 3).

Experimental example—1

The heating roller 1 had a sprayed layer of Teflon, and pressing roller 2 had an elastomeric layer having a thickness of 4 mm and a rubber hardness (JISA) of 60 degrees. The rollers 1, 2 were pressed against each other by pressing the pressing roller under 120 kg, and had a nip width 1 of 6.0 mm.

The contact pressure C was 11 kg/cm$^2$ as calculated from the equation (1).

When the rollers 1, 2 were rotated at a peripheral speed of 100 mm/sec., the ratio 1/V was 0.06 sec. as calculated from the equation (2).

Under the above fixing conditions, a full-color copy was produced by superposing three color toners. the lower fixing limit temperature (fixing starting temperature in FIG. 3) was 100° C., and the hot offset producing temperature (offset starting temperature in FIG. 3) was 130° C., so that the fixing temperature range in which good image fixing can be effected was 30° C. This was as effective as a substantial increase in the rubber range of the toners. A well fixed image having glossiness of 20% was produced. In this example, all sheets of transfer paper could be used. Many types of transfer paper than can be used were available, or the availability of transfer paper was high.

Experimental example—2

The same heating roller 1 and pressing roller 2 as in the experimental example 1 were used. The total pressure P and the peripheral speed V for the heating roller 1 and the pressing roller 2 were selected such taht the contact pressure C was 10 kg/cm$^2$ and 1/V was 0.11 sec. Otherwise, the conditions were the same as those of the experimental example—1. As a result, the fixing temperature range was 40° C., and the glossiness was 30%. The availability of transfer paper was high, and all types of copy sheets ranging from 24 g/cm$^2$ to 90 g/cm$^2$ could well be used.

Experimental example—3

Under the same conditions as those of the experimental example—1 except for C=10 kg/cm$^2$ and 1/V=0.13 sec., the fixing temperature range was 40° C., and the glossiness was 35%. Good images were produces as in the experimental example—2.

Experimental example—4

Under the same conditions as those of the experimental example—1 except for C=7 kg/cm$^2$ and 1/V=0.13 sec., the fixing temperature range was 30° C., and the glossiness was 20%. Good images were produced as in the experimental example—1.

As can be seen from the result of the above experimental examples and their fixing conditions, toners of a small rubber range and a small molecular weight can be fixed by a heating roller having a surface layer of Teflon by giving special fixing conditions that could not be assumed from the fixing conditions in ordinary image fixing devices.

In order to check the limits of the above special fixing conditions, the following comparative experiment was carried out:

Comparative example—1

Under the same conditions as those of the experimental example—1 except for C=11 kg/cm$^2$ and 1/V=0.05 sec., the fixing temperature range was reduced to 20° C. and the glossiness was lowered to 15%. The availability of transfer paper was bad.

Comparative example—2

Under the same conditions as those of the comparative example—1 except for C=6 kg/cm$^2$ and 1/V=0.11 sec., the fixing temperature range was reduced to 20° C. and the glossiness was lowered to 15% as with the comparative example—1. The image fixing device were not practically feasible.

The results of the above comparative examples indicate that the image fixing device will be practically feasible if C≧7 kg/cm$^2$ and 1/V≧0.06 among the fixing conditions.

The following experiment was further conducted in order to show that the fixing conditions in each of the aforesaid experimental examples are well beyond the obviousness range that can be achieved by those skilled in the art.

Conventional example—1

The same experimental conditions as those of the experimental example—1 except for 1/V−0.04 sec. and 1/V=3 kg/cm$^2$, which are ordinary conditions in an image fixing device using a heating roller using a Teflon surface layer, were employed. As a result, the fixing temperature range was 0° C., the glossiness was unmeasurable, and it was impossible to fix toners to any types of transfer paper.

Therefore, the fixing conditions employed in the fixing method of the present invention are quite beyond normal setting ranges.

The following experiment was also conducted under the same conditions as those of the conventional example—1 using an image fixing device having a heating roller with a surface layer of RTV (Room Temperature Vulcanization) silicone rubber coating, which is used as a fixing roller in a conventional full-color copying apparatus:

Conventional example—2

Under the fixing conditions that 1/V=0.04 sec., and C=3 kg/cm$^2$, the fixing temperature range was 40° C. and the glossiness was 40%. The image fixing device was therefore well practically feasible. However, for reasons not known, the toners could not be fixed to all of the sheets of transfer paper that were used in the experiment.

The results of the above experiments are tabulated in the following table 1:

TABLE 1

| | 1/V (sec.) | C (kg/cm$^2$) | Fixing temp. range (°C.) | Glossiness (%) | Paper availability |
|---|---|---|---|---|---|
| A - 1 | 0.06 | 11 | 30 | 20 | Good |
| A - 2 | 0.11 | 10 | 40 | 30 | Good |
| A - 3 | 0.13 | 10 | 40 | 35 | Good |
| A - 4 | 0.13 | 7 | 30 | 20 | Good |
| B - 1 | 0.05 | 11 | 20 | 15 | Bad |
| B - 2 | 0.11 | >6 | 20 | 15 | Bad |
| C - 1 | >0.04 | >3 | 0 | — | Bad |
| C - 2 | >0.04 | >3 | 40 | 40 | Bad |

A: Experimental example
B: Comparative example
C: Conventional example

The availability of transfer paper was judged "Good" if all of the types of transfer paper could be used, and judged "Bad" otherwise.

The thickness of the toner layer on a copy sheet produced in a full-color copying process is greater than the thickness of the toner layer on a copy sheet produced in a monochromatic copying process. In a full-color copying process, the toners cannot well be fixed unless the toner layer is heated quickly into the rubber range. In a conventional full-color copying fixing device, therefore, it has been necessary to provide heaters in the heating and pressing rollers for heating a copy sheet on its both surfaces to thereby increase heat transfer to the toner layer on the copy sheet.

Such a conventional fixing device however consumes a great amount of electric power such as 900 W, and hence cannot be used with a normal electric outlet (having a capacity of 100 V, 15A). To avoid this difficulty, it has been practice to lower the copying rate (the number of copies that can be produced per minute) of a conventional color copying machine below its copying capacity. This is a substantial reduction in the copying machine performance. Moreover, since the pressing roller is supported displaceably with respect to the heating roller, it is not preferable to provide a heater in the pressing roller.

As is well known in the art, it is possible to lower the heating temperature by increasing the contact pressure C between the heating roller and the pressing roller.

The same experiments as those described above were conductec using an image fixing device with the heater 3 removed from the pressing roller 2 shown in FIG. 1. The experimental results are given in the following table 2:

TABLE 2

| | l/V | C | Fixing temp. range (°C.) | Evaluation |
|---|---|---|---|---|
| A - 1 | 0.06 | 7 | 30 | Good |
| A - 2 | 0.11 | 10 | 40 | Good |
| A - 3 | 0.13 | 10 | 40 | Good |
| A - 4 | 0.13 | 7 | 30 | Good |
| B - 1 | 0.05 | 11 | 20 | Bad |
| B - 2 | 0.11 | 6 | 20 | Bad |
| C - 1 | 0.04 | 3 | 10 | Bad |
| C - 2 | 0.04 | 3 | 30 | Good |

A: Experimental example
B: Comparative example
C: Conventional example

The evaluation "Good" indicates that the toners can be fixed, and the evaluation "Bad" indicates that the toners cannot be fixed. This evaluation is not related to the availability of transfer paper.

Table 2 shows that an image fixing device with a heater disposed only in the heating roller can well fix images or toners to copy sheets. A copying machine with such an image fixing device can reduce electric power consumption and increase the copying rate.

With the present invention, as described above, even if full-color copying toners having a small molecular weight and a small molecular weight distribution are employed, the temperature range corresponding to the good fixing temperature range can be increased. The toners can be fixed completely before they are offset. Therefore, the fixing roller can have a surface layer of Teflon for utilizing the advantageous features of Teflon.

Since the temperature range in which the toners can be fixed can easily be achieved by increasing the temperature range known as the rubber range, temperature control can be effected with ease.

Although a certain preferred embodiment has been shown and described, it should be understood that many changes and modifications may be made therein without departing from the scope of the appended claims.

What is claimed is:

1. A method for fixing a multicolor toner image to a toner carrier between a heating roller and a pressing roller which are rotatably pressed against each other, said method comprising the steps of:

(i) selecting the ratio (1/V) between the nip width (1) of the heating and pressing rollers and the peripheral speed (V) of the rollers to be at least 0.06;

(ii) selecting the pressure of contact per unit area between the heating and pressing rollers at their nip region to be at least 7 kg $cm^{-2}$;

(iii) using low molecular weight polymer compounds as the toners and a toner carrier bearing a number of non-fixed toners of different colors; and (iv) using a heating roller which has a surface layer of Teflon and a pressing roller which has a surface layer of an elastomeric material.

2. The method of claim 1, comprising using toners having a small molecular weight distribution and small toner cohesive forces.

3. The weight of claim 1, wherein a pressing roller having a surface layer of silicone rubber is used.

4. The method of claim 1, comprising using a means for detecting the surface temperature of said pressing roller.

5. The method of claim 4, comprising maintaining the surface temperature of said heating roller at a temperature corresponding to the rubber range of the toner.

6. The method of claim 1, comprising applying silicone oil to the circumferential surface of said heating roller.

* * * * *